United States Patent [19]

Price

[11] 4,257,767

[45] Mar. 24, 1981

[54] FURNACE TEMPERATURE CONTROL

[75] Inventor: John C. Price, Roanoke, Va.

[73] Assignee: General Electric Company, Salem, Va.

[21] Appl. No.: 35,023

[22] Filed: Apr. 30, 1979

[51] Int. Cl.[3] ..... F27D 7/00; C21B 7/24

[52] U.S. Cl. ..... 432/24; 266/80

[58] Field of Search ..... 432/11, 24, 49; 266/80

[56] References Cited

U.S. PATENT DOCUMENTS

| | | | |
|---|---|---|---|
| 3,604,695 | 9/1971 | Steeper | 432/11 |
| 3,695,594 | 10/1972 | Hollander | 432/11 |
| 4,087,238 | 5/1978 | Seigel | 432/49 |

*Primary Examiner*—John J. Camby

*Attorney, Agent, or Firm*—Arnold E. Renner

[57] ABSTRACT

In controlling a slab reheat furnace, the average temperature of each slab in a zone, is predicted as a function of the radiation heat source temperature in the zone, and the thermal properties, dimensions, location, velocity, and past thermal history of the slabs. The predicted slab temperatures are compared with a range of desired slab temperatures and the slab requiring the greatest time to be heated to its desired temperature is identified. The furnace is controlled in such a manner that the identified slab will be heated to the desired temperature. Slabs likely to be overheated are identified and, if a predetermined temperature limit is to be exceeded, the furnace is controlled to prevent further heating of the slabs. Gas temperatures throughout the zone are predicted based upon only one sensed temperature in the zone.

16 Claims, 6 Drawing Figures

FURNACE TEMPERATURE CONTROL

CROSS REFERENCE TO RELATED PATENT

METHOD AND APPARATUS FOR CONTROLLING A SLAB REHEAT FURNACE, U.S. Pat. No. 3,604,695, issued Sept. 14, 1971 to D. E. Steeper, here the "First Furnace Temperature Control Patent", the disclosure of which is incorporated by reference.

BACKGROUND OF THE INVENTION

1. Field of the Invention

The present invention relates generally to slab reheat furnaces and, more particularly, to a technique for controlling the operation of such furnaces.

2. Description of the Prior Art

Elongated metal strips are produced in a facility known as a hot strip mill by rolling a slab, bar, or other bulk form of metal through successive stands of rollers. For convenience various bulk forms of metal will be referred to as slabs. As a slab progresses through the mill, it is increasingly thinned and elongated until it becomes a strip of thin metal. It will be appreciated that a great deal of work must be done by the rollers which compress the slab in order to work the slab into finished strip form. Because metal at an elevated temperature exhibits less resistance to deformation than metal at a lower temperature, the initial gross reductions in thickness are made while the slab is at an elevated temperature. Slabs are heated to a typical elevated temperature of about 2200 degrees Fahrenheit (°F.) in a so-called slab reheat furnace. A slab reheat furnace thus performs the function of heating slabs from ambient temperature as stored in a "slab yard" to a desired elevated temperature deemed to be appropriate for the particular slab material and the type of rolling to follow.

On a production line a number of slabs are fed into the furnace sequentially. The speed of the slabs through the furnace and the temperature levels in the furnace are selected so that each slab being discharged from the furnace comes as close as possible to its desired temperature. Heating slabs to elevated temperatures would be relatively simple if each slab were of the same composition and dimensions, and were to be rolled to the same thickness in the same period of time. A typical hot strip mill does not operate in such a consistent manner, however, and slabs vary greatly in composition, dimension, and in processing requirements. Mill delays, whether planned or unplanned, also influence the travel of the slabs through the furnace. In short, depending upon individual requirements, slabs have to be heated to different temperatures and this means that the heating capabilities of the furnace must be adjusted as accurately as possible.

It has long been recognized that manual control of slab reheat furnaces is not the most efficient way to operate such furnaces. Slab composition, thickness, width, extraction interval, final desired thickness, and final desired temperature, as well as mill delays, all interact to make it exceedingly difficult to properly control the furnace to achieve the goal of heating each slab to a particular desired temperature. Under manual control, the differences among various slabs rarely are taken into account and slabs exiting the furnace often are heated improperly. Also, it is of increasing concern that much fuel may be wasted in the operation of a reheat furnace due to improper control.

In response to these concerns, the use of a process computer control for a slab reheat furnace was developed. The First Furnace Temperature Control Patent represented a significant step forward in utilizing computer technology to control the operation of a slab reheat furnace. The First Furnace Temperature Control Patent provides significant advantages in the operation of reheat furnaces, including:

1. Reduced fuel consumption. This benefit arises from the ability to control the slab heating at all times in accordance with strategy prescribed by efficient operation of the mill.

2. Increased furnace capacity. This is because the control system can respond quickly to changes in material flow and various delays. Slabs also can be delivered to the mill rolling equipment at a temperature which avoids the need for delays before entering the rolling equipment or for rolling at reduced speeds. In other words, the rest of the mill equipment can be operated at full capacity because slabs are delivered to the equipment at the proper temperature.

3. Better surface quality. Automatic control is sufficiently accurate that excessive scale formations, melting of the surface of the slab, and other undesirable characteristics are avoided.

Automatic reheat furnace control systems prior to the First Furnace Temperature Control Patent were not entirely satisfactory because they did not directly regulate slab temperature. They depended upon stored models to estimate slab temperature independently of specific information concerning the temperature of each slab as it progressed through the furnace.

The First Furnace Temperature Control Patent disclosed and claimed a greatly improved method and apparatus for controlling operation of a slab reheat furnace. In that patent, the average temperature of a slab in a given zone was predicted as a function of the gas temperatures in the zone, the thermal properties of the slab, the dimensions of the slab, the location of the slab within the zone, the rate of movement of the slab, and the thermal history of the slab. The predicted average temperature then was compared with a desired temperature at the same location based on a predetermined desired slab temperature trajectory. A performance index was established as a function of the combined comparisons for all slabs within the zone. The performance index was used to calculate a temperature setpoint, that is, a desired zone temperature. The heat output of the furnace was adjusted in accordance with the magnitude and direction of the difference between the setpoint and measured zone temperatures. The First Furnace Temperature Control Patent provided, for the first time, a truly automatic and effective technique for controlling the operation of a slab reheat furnace.

Although the First Furnace Temperature Control Patent represents a significant advance in the technology, certain concerns still have not been addressed. One of these concerns relates to the manner in which the performance index is determined. In the patent, the calculated average temperature of each slab was compared with a predetermined desired temperature of the slab at a given location. The temperature deviations of all slabs in a given zone were calculated periodically and the deviations were averaged. Because the temperature of slabs near the exit end of the zone is more critical than the temperature of slabs near the entrance to the zone, the temperature deviations of the slabs were weighted in favor of those near the exit end of the zone.

The weighted temperature deviations than were summed to establish a zone performance index. This is a fairly complex technique to derive a performance index and, although the technique is accurate, it does not address itself to the thermal requirements of individual slabs.

Another concern not addressed by the First Furnace Temperature Control Patent relates to the means by which temperatures existing within the furnace are determined. In the patent, a thermocouple was placed on the roof of each zone of the furnace, as well as in the exhaust stack. A thermocouple was located at the transition point between a preheat zone and a heat zone within the furnace. In addition, radiation pyrometers were located at the transition from the preheat zone to the heat zone and from the heat zone to a soak zone to sense the temperature of each slab as the slab passed from one zone to the other. Obviously, if a number of thermocouples and pyrometers are employed in a furnace, a good indication of the heat distribution within the furnace can be determined. The greater the number of these sensors, the easier it will be to determine the heat profile within the furnace; in turn, the easier it will be to control operation of the furnace.

Even in the First Furnace Temperature Control Patent, however, the temperature in each zone was assumed to vary linearly from the sensed entry temperature to the sensed exit temperature. That was a simplistic assumption which did not accurately predict the radiation heat source temperature experienced by each slab. In many existing furnaces temperature sensors are placed at only one location along the length of each zone. Although it would be possible to modify existing furnaces to add more thermocouples and pyrometers, it would be desirable to employ existing equipment, if possible, to achieve proper furnace control. It also would be desirable for the assumed temperature distribution throughout the furnace to more accurately reflect the temperatures actually experienced by the slabs.

SUMMARY OF THE INVENTION

The invention overcomes the foregoing and other concerns of prior art proposals by providing a new and improved technique for controlling the operation of a slab reheat furnace. The average temperature of slabs in a given furnace zone is predicted as a function of the radiation heat source temperatures in the zone, the thermal properties of the slabs, the dimensions of the slabs, the location of the slabs within the zone, the rate of movement of the slabs, and the thermal history of the slabs. The radiation heat source temperature is defined as that temperature which, in a one-dimensional (y-axis) heat-transfer calculation, results in the same slab heating rate as results from the combined effects of radiation from gas and from refractory along the length of the zone in a two-dimensional (x, y-axes) heat-transfer calculation. The specific technique for calculating the average temperature of each slab is improved compared to prior computational techniques. The radiation source temperatures in the zone can be determined from only a single temperature measurement in the zone. This is brought about by employing a heat-source shaping curve which represents the temperature difference, or offset, at any location between a radiation heat source and the measured temperature in the zone. The heat-source offset has been determined as a function of distance from the heating elements in the zone, slab thickness, rate of travel of the slabs through the zone, and type of fuel. The average temperature of each slab is then calculated by the fourth-power radiation law, and compared with a desired temperature at the same location based on a predetermined desired slab temperature trajectory.

The invention avoids the use of a performance index per se. The temperature deviation of the individual slab which is furthest below its desired average temperature, or alternatively, which will require the greatest heating time to reach its desired average temperature is determined. The temperature deviation of the individual slab which is, or will be heated above its desired average temperature by the greatest amount also is determined. If no slab is found to be underheated, the temperature deviation of a selected overheated slab is used as the first-calculated deviation. The selected overheated slab will normally be the one which is furthest above its desired average temperature, but other criteria may be used for selecting this slab. Assuming that there is no danger of overheating any of the slabs, the first-calculated deviation is employed to adjust the output of the heating means. If the second-mentioned deviation exceeds a predetermined limit, the first-mentioned deviation is not employed and the output of the heating means is reduced or kept constant to prevent damage to the overheated slab. When the foregoing steps are used to control operation of a slab reheat furnace, the furnace can be controlled effectively with only a minimum number of temperature sensors located throughout the furnace. These advantages and a fuller understanding of the present invention may be had by referring to the following description and claims, taken in conjunction with the accompanying drawings.

DESCRIPTION OF THE PREFERRED EMBODIMENT

Figure 1:
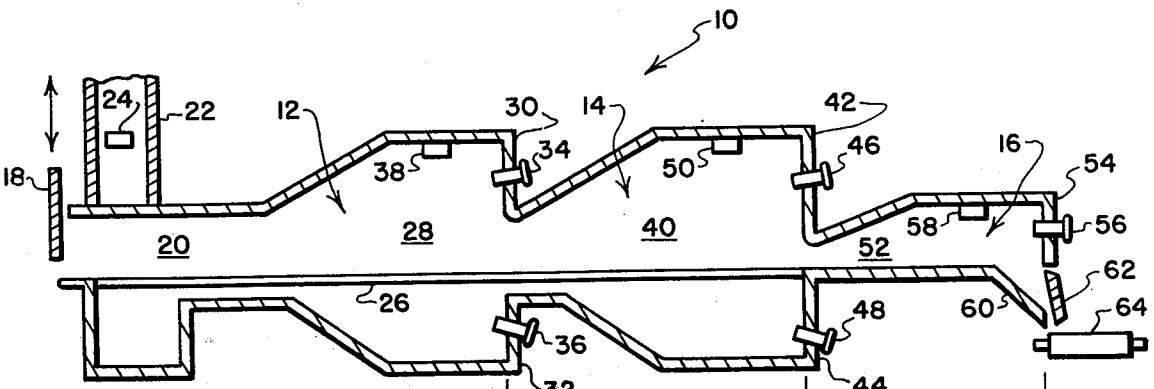
FIG. 1 is a schematic representation of a slab reheat furnace, showing the location of the burners and temperature sensors.

Referring to FIG. 1, a reheat furnace 10 of the type which could be controlled by the present invention includes a preheat zone 12, a heat zone 14, and a soak zone 16. Although certain components of the furnace 10 have been described in the First Furnace Temperature Control Patent, those components will be described again for purposes of cohesiveness. The invention is not limited in its application to the particular configuration of the furnace 10. For example, the furnace may have more than one zone of each type, or it may have roof or sidewall burners instead of zone-end burners, or it may have a different location of the zone-end burners.

Slabs at ambient temperature taken from a slab storage yard are charged into the reheat furnace 10 one at a time through a charging door 18 leading to a throat 20 preceding the preheat zone 12. An exhaust stack 22 coupled to the throat 20 passes exhaust gases from the reheat furnace 10 into a recuperator (not shown). A thermocouple 24 monitors the temperature of the exhaust gases. If the temperature exceeds a certain maximum limit, cooling sprays (not shown) in the exhaust stack 22 may be used to reduce the temperature of the exhaust gases.

Slabs entering the furnace 10 through the door 18 move along a fixed or movable beam 26 into the preheat zone 12. The preheat zone 12 includes a chamber 28 having an upper firing wall 30 and a lower firing wall 32 containing burners 34, 36, respectively. While the burners 34, 36 are represented by a single element, there normally is a row of such elements extending across the width of the furnace to maintain a uniform temperature gradient from one side of the furnace to the other. The temperature in the chamber 28 is monitored by a thermocouple 38 mounted to the roof of the chamber 28 a short distance from the burners 34. The thermocouple 38 is located at or near the hottest portion of the chamber 28 and consequently the temperature sensed by the thermocouple 38 represents the hottest temperature which can be attained in the chamber 28. The thermocouple 38 is the only temperature sensor in the chamber 28.

The heat zone 14 is similar to the preheat zone 12 and includes a chamber 40. The chamber 40 includes an upper firing wall 42 and a lower firing wall 44 containing burners 46, 48, respectively. A thermocouple 50 is attached to the roof of the heat chamber 40 and is located at or near the hottest part of the heat chamber 40.

The soak zone 16 primarily equalizes temperatures within slabs passing through the soak zone 16. The soak zone 16 includes a chamber 52 having a single firing wall 54 carrying a single row of burners represented by a burner 56. A thermocouple 58 is attached to the roof of the chamber 52 and is located so as to sense the highest temperature in the soak zone. Reheated slabs are discharged from the furnace 10 on a ramp 60 covered by a hinged discharge door 62. The slabs are directed onto roller tables, represented by a roller 64, which transports them to scale-breaking rolls in the rolling mill.

Figure 2:
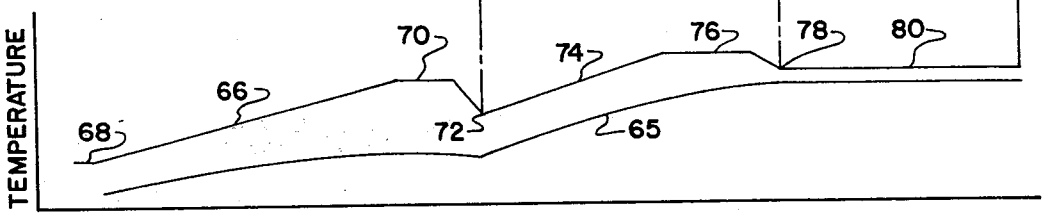
FIG. 2 is a typical profile of gas temperature and desired slab temperatures throughout the length of the furnace.

When slabs are being reheated, the burners are regulated to attempt to establish a desired radiation heat source temperature profile of the type indicated in FIG. 2 by the numeral 65. The actual radiation heat source temperature in the preheat zone 12 increases along an approximately linear curve 66 from a minimum temperature 68 at the entrance to the zone to a plateau 70 within the chamber 28 before falling to an intermediate level 72 at the entrance to the heat zone 14. From the intermediate level 72, the temperature rises along an approximately linear curve 74 to a second plateau 76 in the chamber 40 before falling to a second intermediate level 78 at the entrance to the soak zone 16. Because the soak zone 16 primarily is intended to equalize temperatures throughout slabs, the temperature within the soak zone 16 is practically uniform. In FIG. 2, this is indicated as a horizontal extension 80 of the second intermediate temperature level 78.

Although it can be assumed that the furnace will always contain groups of slabs, the degree of control over the reheating of individual slabs is attained through knowledge of the slopes and magnitudes of the radiation heat source temperature profile in the furnace 10. In accordance with sensed temperature and predicted radiation heat source temperature in a zone, the average temperature of each slab in the zone is calculated as a function of the thermal characteristics of the slab, the radiation heat source temperature at the location of that slab, the dimensions of the slab, the location of the slab within the zone, the velocity of the slab, and the thermal history of the slab. The deviation between the calculated (predicted) average temperature for each slab and a desired average temperature according to a predetermined temperature trajectory such as that shown in FIG. 2 by the numeral 65 is calculated. The temperature deviation of the slab having the "limiting heating requirement" can be driven to zero by successively incrementing the zone temperature setpoint and by periodically recalculating the temperature deviation.

The most important temperature deviation is that of any individual slab which is approaching a surface temperture at which the slab is melted. This is known as "washing" the slab and, if such a condition is imminent, the temperature deviation of that slab surface from the allowable surface temperature will be driven to zero to avoid this result. The other important temperature deviation is that of the individual slab having the limiting heating requirement, that is, the slab requiring (a) the greatest time to reach the desired predetermined temperature or (b) the greatest temperature increase to reach the desired predetermined temperature. In the absence of an underheated slab, the limiting heating requirement will be the slab which is heated furthest above its desired average temperature. As with the control of wash temperature, the temperature deviation of the slab having the limiting heating requirement is driven to zero. The temperature setpoints in the preheat zone 12, heat zone 14, and soak zone 16 are controlled by independent but essentially identical systems. To avoid repetition, only one system is described here.

Predicting the average temperature of each slab in a group of slabs involves identification of the location of each slab within the zone. A preferred technique is described in the First Furnace Temperature Control Patent. The average temperature of each slab at any given location i in the zone is calculated by modeling the slab and employing appropriate heat transfer equations to determine the average temperature of the model. The model, according to the invention, examines a portion of a slab roughly in the form of a cube, having a top surface one square foot in area. The model is H feet high. It has been assumed that the model is symmetrically heated top and bottom by a gas temperature $T_{gi}$ and that the model attains a surface temperature $T_{si}$. In order to determine the average temperature of the slab, the heat input to the slab is examined according to conventional heat transfer equations. It will be assumed that all the heat entering the slab is stored in the slab and, consequently, that there will be an increase of average temperature. Moreover, it will be assumed that the heat stored in the slab must have come from radiation into the surface of the slab. In actual practice, the radiant heat source temperatures above and below the slab may not be equal. In this case, the slab is divided into equal top and bottom thicknesses for the purpose of calculation, and the slab average temperature is determined from the average temperatures of the top and bottom halves. A reasonable assumption is that the temperature distribution in a slab heated uniformly from above and below is parabolic. Therefore, the average temperature $T_{ai}$ of a slab having a center temperature $T_{ci}$ and equal surface temperatures $T_{si}$ would be: (1) $(T_{ci}+2T_{si})/3$.

Based on the foregoing assumptions, the following nonlinear, simultaneous differential equations have been obtained:

$$T_{si} = T_{ai} + \frac{\rho C H_i^2}{12K} \cdot \frac{dT_{ai}}{dt} = T_{ai} + K_1 H_1^2 \cdot \frac{dT_{ai}}{dt} \quad (2)$$

$$\frac{dT_{ai}}{dt} = \frac{2\sigma e_i}{\rho C H_i} [(T_{gi} + 460)^4 - (T_{si} + 460)^4] = \frac{K_2 e_i}{H_i} [(T_{gi} + 460)^4 - (T_{si} + 460)^4] \quad (3)$$

Where $T_{si}$=surface temperature of a slab at location i in degrees Fahrenheit;

$T_{gi}$=gas temperature at location i in degrees Fahrenheit;

$T_{ai}$=average temperature of a slab at location i in degrees Fahrenheit;

$e_i$=emissivity at location i;

$\delta$=Stefan-Boltzman Constant ($0.172\times10^{-8}$ BTU/-Hour-Ft$^2$−°R$^4$);

C=slab heat capacity in BTU/lb.−degrees Fahrenheit;

$\rho$=slab density in lb./ft$^3$;

$H_i$=thickness of slab at location i in feet;

K=slab heat conductivity in BTU/ft-hr.−°F.;

$$K_1 = \frac{\rho C}{12K}; \text{ and,}$$

$$K_2 = \frac{2\sigma}{\rho C}.$$

The length and width of the slabs are assumed to be constants with only the thickness H being considered a variable. While several of the terms of the second and third equations are independent of the location of a slab within a zone, others such as radiation heat source temperature and emissivity may vary with the location of the slab within a zone. Emissivity at a given location i is influenced by the surface condition of the slab and may be approximated by the linear equation: (4) $e_i=e_o+mL$. Conductivity at a given location i is a function of slab average temperature at that location. Equation (4) is described more completely in the First Furnace Temperature Control Patent. In equation (4), $e_i$=emissivity of slab at location i;

$e_o$=emissivity of slab at furnace entrance;

L=distance from furnace entrance in feet; and m=coefficient relating slab emissivity and location.

Figure 3:
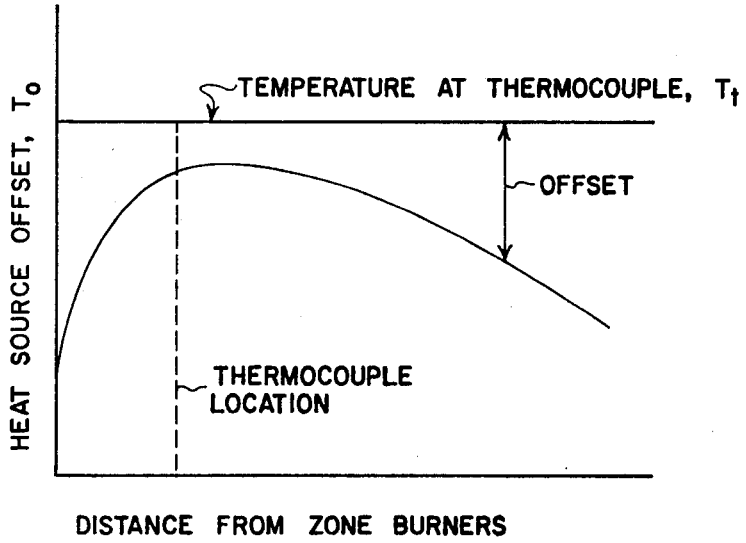
FIG. 3 is a representative heat-source shaping curve plotting heat-source offset temperature as a function of distance from zone burners, among other variables.

In the present invention, the radiation heat source temperature profile of the zone is established by measuring only one temperature, $T_t$, from the zone thermocouple 38, 50, or 58. The radiation heat source temperature profile in a zone is calculated from an "on-line" model. This model stores in the furnace control computer data which may be generated by simulating furnace operations in an "off-line" calculation, or by logging of furnace parameters in an actual furnace to develop an empirical relationship between furnace operating parameters and the effective radiation heat source at each location in the furnace. In the off-line model, heat-source shaping data for a number of specified operating conditions is calculated and plotted. A heat-source offset $T_o$ is defined as the difference between the temperature sensed by the zone thermocouple $T_t$ and the temperature of a radiation heat source model of the zone along the length of the zone. The heat-source offset $T_o$ is a function of distance from the zone burners, slab thickness, slab velocity, and type of fuel, for example, natural gas, coke-oven gas, or other fuels. Thus the off-line heat-source shaping model is a family of nonlinear curves related to these parameters. One of these curves is shown in FIG. 3.

Figure 4:
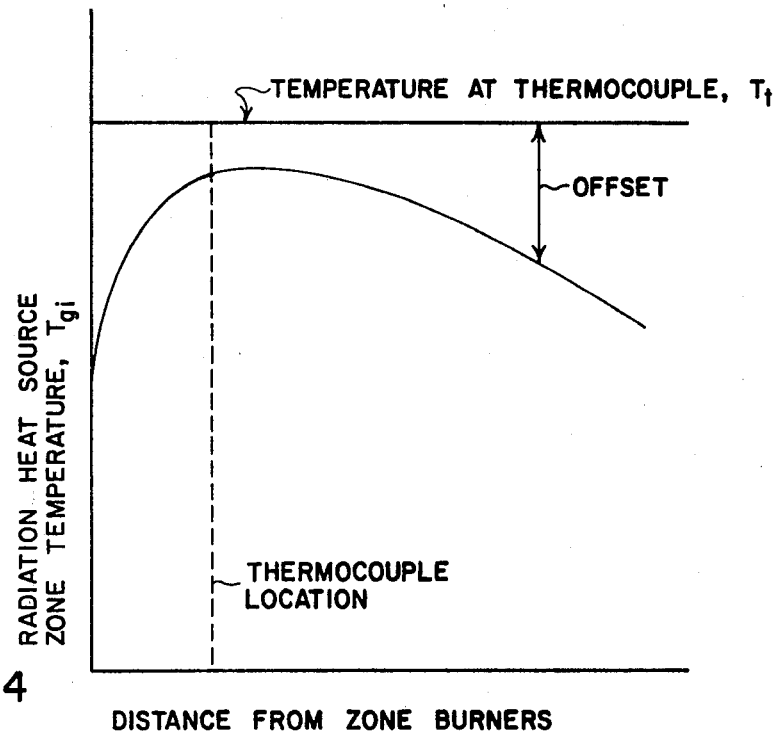
FIG. 4 is a heat-source shaping curve, plotting radiation heat source temperature as a function of distance from the zone burners.

In the on-line control system, the heat-source offset $T_o$ is employed to calculate the temperature $T_{gi}$ of a radiation heat source at a location i in the zone. $T_{gi}$ is defined as that temperature at location i which will represent in the one-dimensional on-line calculation the actual heat flux resulting from a two-dimensional heat transfer calculation from all radiation sources along the length of the zone. These radiation sources include gas, refractory, and radiation reflected from slabs. Once $T_o$ has been determined for each slab in a zone as a function of location and operating parameters by referring to the off-line model for those particular conditions, the value of the offset $T_o$ is subtracted from the measured temperature at the zone thermocouple 38, 50, or 58 to determine the radiation heat-source temperature $T_{gi}$ as shown in FIG. 4. The temperature $T_{gi}$ then is used in the radiation heat transfer calculation for the slab to which it applies (equation 3).

The present invention includes a slab average temperature regulator. In carrying out the present invention, the average temperature of each slab in a zone is calculated by solving equation (3) after determining the gas temperature $T_{gi}$ from the on-line model as illustrated in FIG. 4 and after substitution of $T_{si}$ from equation (2). The emissivity is calculated from equation (4), the conductivity is determined from stored conductivity versus temperature data, and the thickness of the slab is taken from previous measurements. The average temperature $T_{ai}$ of each slab is compared with a desired temperature $T_{di}$ of a slab in that location as taken from a predetermined slab temperature trajectory of the type shown in FIG. 2 to determine the temperature deviation $\Delta T_{di}$ between the two. The temperature deviation is used in subsequent calculations to control operation of the furnace.

The deviations of slabs near the the exit from the zone naturally are more critical than the deviations of slabs near the entry to the zone. To reflect this criticality, the First Furnace Temperature Control Patent employed a weighting factor to rank the importance of each deviation in a zone as function of the location of the slab within the zone. The present invention avoids the use of a separate weighting function calculation and the subsequent summing of weighted temperature deviations in the zone. These results are achieved by comparing the deviation of each slab to that of the other slabs and determining which slab in the zone has the limiting heating requirement. The limiting heating requirement refers to that slab which is farthest from its desired temperature, or, alternatively, which will require the greatest amount of time to be heated to its desired average temperature. Although the limiting thermal requirement could be established on various grounds such as the slab having the greatest temperature deviation below desired temperature, the slab having the greatest temperature deviation above desired temperature, or the slab requiring the longest time to cool to the desired average temperature, it is believed most advantageous for the limiting heating requirement to be based on the longest time to heat a given slab.

The heating requirement for each slab can be determined by dividing the temperature deviation $\Delta T_{di}$ by the value for rate of change of average temperature ($dT_{ai}/dt$) found by solving equation (3). Once the slab having the greatest heating requirement has been identified, the temperature deviation of that slab is used as a reference signal to a closed-loop regulator which acts to drive the temperature deviation toward zero. This means that the set point developed by the regulator will cause the burners to be adjusted appropriately to raise the temperature of the slab having the limiting heating requirement. If all of the slabs are overheated, the slab having the limiting heating requirement will have a negative temperature deviation, and the burners will be adjusted appropriately to cool that particular slab to its desired average temperature. If some of the slabs are overheated and some are underheated, the underheated slabs will be controlling and the burners will be adjusted to raise the temperature of the underheated slabs.

The foregoing approach potentially could result in washing of certain slabs. This is because the output of the burners will be increased any time a slab having a positive temperature deviation is detected, even if slabs having a negative temperature deviation also exit. It would be possible, then, for slabs already heated at or above their desired average temperature to be heated even further. In certain circumstances, it would be possible for certain of the slabs to become washed. This undesirable result is avoided by employing a surface temperature regulator which overrides the average temperature regulator previously described. The limiting temperature deviation for the surface temperature regulator is defined as the temperature deviation of that slab which will become washed if the temperature deviation of the slab having the limiting heating requirement is driven to zero. In such a case, the limiting surface temperature deviation is controlling and the setpoint is adjusted to prevent washing of the slab in question.

Figure 5:
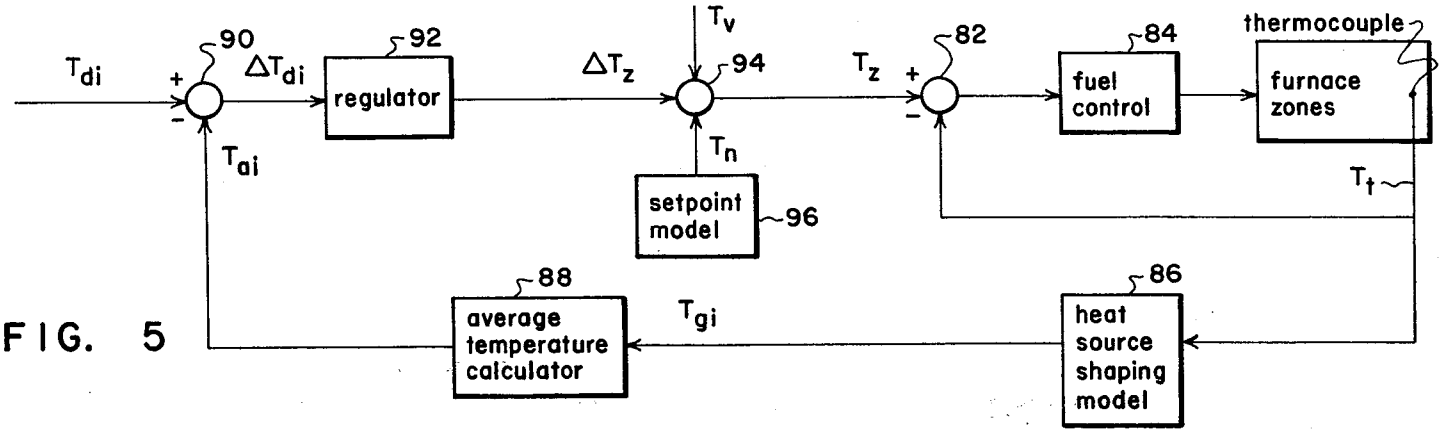
FIG. 5 is a block diagram of an apparatus incorporating the concepts of the present invention to control the desired average temperature of a slab.
Figure 6:
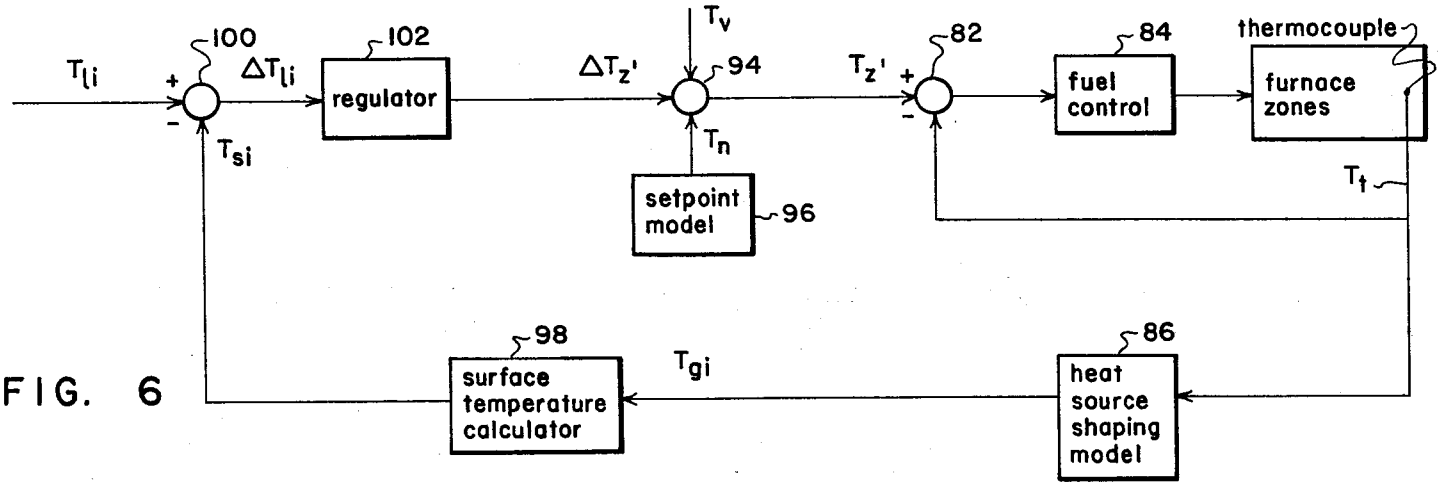
FIG. 6 is a block diagram of an apparatus incorporating the concepts of the present invention to control the maximum temperature to which a slab may be heated.

The method set forth above may be practiced with analog or digital apparatus of the type described functionally with reference to FIGS. 5 and 6. Digital apparatus is preferred and the invention has been carried out successfully by using a Honeywell 4000 series process computer. The function of the system is to determine the temperature setpoint $T_z$ which, when applied to a summing junction 82 along with an input $T_t$ from one of the thermocouples 38, 50, 58, permits a fuel flow control system 84 to vary the fuel flow, and thus the zone temperature as measured by the zone thermocouple in a predetermined manner. The determination of the temperature setpoint signal $T_z$ is the end result of a process which is repeated at least each time the number or location of the slabs within a zone is changed or at predetermined intervals if no change in slab number or location has occurred.

The temperature $T_t$ sensed by the zone thermocouple is applied to a heat source shaping model 86 which generates an output signal representing the zone radiation heat source temperature $T_{gi}$, as shown in FIG. 4. In the initial calculation, $T_{gi}$ applies to the first slab location in the zone. The output signal from the generator 86 is applied to a calculator 88 which solves equation (2) to predict the average temperature $T_{ai}$ of the slab in the first location. This result is applied to an adder circuit 90. The desired slab temperature $T_{di}$ at the first location is applied to the adder circuit 90. The output of the adder circuit 90 represents the deviation $\Delta T_{di}$ of the predicted average temperature $T_{ai}$ from the desired slab temperature $T_{di}$ at the first location. The time to reach the desired average temperature is calculated by dividing the output of the adder circuit 90 by the value $dT_{ai}/dt$ determined from equation (3).

The apparatus repeats the foregoing calculations for other slab locations in the zone. The zone temperature at the second slab location is applied to the calculator 88 which determines the average temperature for the slab at the second location. The average temperature, the desired temperature and the time to reach the desired average temperature are predicted for the slab at the second location in the same manner as they were for the slab in the first location. If the limiting heating requirement for this slab is greater than that for any preceding slab, these data for this slab are saved for comparison with those for following slabs.

After all slabs have been examined in the foregoing manner, the average temperature deviation for the slab with the limiting heating requirement is known.

This deviation signal is applied to regulator 92. The regulator 92 includes an exponential forward gain, an integrator, and a lead time constant. These components account for the thermal lag which exists in any heating process. Stated differently, a typical slab may have a time constant of one-half hour to respond to a change in zone setpoint. Accordingly, the regulator stabilizes operation of the furnace zone controls 84 to account for this thermal lag. If $T_{ai}$ and $T_{di}$ applied to the adder circuit 90 are identical, then no deviation signal will be produced from the adder circuit. In this case, the regulator is not activated. If a positive deviation signal exists, the regulator 92 will be activated to drive the deviation toward zero. The input from the adder circuit 90 is stored in the regulator 92 in data storage circuits.

If the limiting thermal requirement has been defined as that slab having the greatest deviation from desired temperature, the output of the regulator 92 is nothing more than a signal which is a function of the greatest temperature deviation among all locations in the zone. The output of the regulator 92, $\Delta T_z$, will be positive or negative, depending upon whether the slab having the limiting heating requirement is underheated or overheated. If the limiting heating requirement is defined as the slab requiring the greatest time to be brought to desired average temperature, then the regulator will calculate the ratio of $\Delta T_{di}$ to ($dT_{ai}/dt$) and produce an output signal $\Delta T_z$ which is a function of the calculated value.

The output of the regulator 92, $\Delta T_z$, is applied to a summing junction 94 having other inputs representing the nominal temperature $T_n$ about which the zone is to be operated, and a vernier or bias temperature $T_v$ which may be set by the furnace operator to reflect any observed long term changes or to introduce temperature differentials as between the top and bottom of the slab or the upstream and downstream halves of the slab as may be required to aid in rolling the slab. The nominal temperature $T_n$ is developed by a setpoint model 96. The model 96 stores in the furnace control computer data which may be generated by simulating furnace operation in an off-line calculation, or by logging of furnace operation in an actual furnace to develop an empirical relationship between furnace operating parameters and the zone setpoints required when those parameters prevail. The model 96 takes into account the dimensions of the zone, the thickness of the slabs, the desired slab temperature trajectory, and the velocity of the slabs (push rate) through the zone. By way of example, if the zone under consideration is the heat zone 14, and the desired temperature of slabs exiting the heat zone 14 is to be 2,200° F., the setpoint model 96 may generate a nominal temperature $T_n$ of 2,400° F. Assuming that one of the slabs in the heat zone is underheated, a signal $\Delta T_z$ will be produced by regulator 92 and applied to the summing junction 94. Delta $T_z$ will be a positive number for underheated slabs. On the further assumption that the operator has not applied a signal $T_v$ to the summing junction 94, $T_n$ and $\Delta T_z$ will be added to produce a final setpoint which is applied to the summing junction 82. The final setpoint, $T_z$, will be a positive number and, in the example given, will exceed 2,400° F., for example it would be 2450° F. A feedback signal from the zone thermocouple also is applied to the summing junction 82. On the assumption that the zone thermocouple senses a temperature of 2,300° F., the output of the summing junction 82 will be a signal proportional to a temperature increase of (2450° F.–2300° F.), or 150° F. This temperature signal will be applied to the zone controls 84. In turn, the output of the burners will be increased by an amount which should raise the zone temperature 150° F. A closed loop control system thus is provided which continually updates itself and heats slabs to temperatures at, or very close to, the slab temperature trajectory illustrated in FIG. 2.

The invention also includes protection against overheating of the slabs by use of a surface temperature regulator. This is achieved by calculating the surface temperature of each slab and identifying the slab whose surface temperature $T_{si}$ exceeds its limit temperature $T_{Li}$ by the greatest amount. The temperature limit $T_{Li}$ may be a function of the chemical composition of the particular slab in a mill where a range of steel compositions are rolled. This protective feature is illustrated schematically in FIG. 6. Many of the components are the same as those used in the apparatus of FIG. 5, and like numerals will be carried over where appropriate.

The output of the heat source shaping generator 86 is applied to a calculator 98 which, when provided with a value for radiation heat source temperature $T_{gi}$ at any location in the zone, calculates the surface temperature $T_{si}$ of the slab at that location. This calculation is performed by solving equation (2) after the calculator 88 has solved equation (3) for a slab average temperature $T_{ai}$.

In a manner analogous to the apparatus of FIG. 5, the temperature $T_{si}$ of the slab with the limiting surface temperature condition is applied to an adder circuit 100 to which a predetermined limit temperature $T_{Li}$ also is supplied. The output of the adder circuit 100 is a limit temperature signal $\Delta T_{Li}$. Delta $T_{Li}$ is zero or is a negative number where the surface temperature is less than the wash temperature. Delta $T_{Li}$ is a positive number where the surface temperature of the slab is greater than the wash temperature. The signal representing $\Delta T_{Li}$ is applied to a regulator 102 similar to the regulator 92, except that the gain and time constant terms are those which are appropriate to the regulation of slab surface temperature. The output of the regulator 102, $\Delta T_{z,,}$ is applied to the summing junction 94, as is the signal $\Delta T_z$.

If value for $\Delta T_{Li}$ is not a positive number, then the output $\Delta T_z$, of the regulator 102 will be zero. If the value for $\Delta T_{Li}$ is a positive number, then the value of $\Delta T_{Li}$ will be used to generate a signal $\Delta T_z$, which is fed to the summing junction 94. In the event a value for $\Delta T_z$, is generated, the regulator 92 is disabled immediately, unless it requires a greater decrease in setpoint than $\Delta T_z$, requires. This prevents the possibility that any further increase in zone temperature could occur. The value for $\Delta T_z$, will immediately decrease the final setpoint $T_z$, emanating from the summing junction 94 such that the zone controls 84 will decrease fuel flow immediately. The extent to which the zone controls 84 are decreased depends on the output from the summing junction 82, where the setpoint $T_z$, is compared with the sensed zone temperature $T_t$. As with the embodiment of FIG. 5, the limit temperature circuit is a closed loop which continuously updates itself as slabs progress through the furnace.

Reference is made to the First Furnace Temperature Control Patent for a description of additional features such as calculation intervals and adjustment of emissivity values. It will be appreciated from the foregoing description that the invention provides all the advantages of the First Furnace Temperature Control Patent and, additionally, addresses itself to the thermal condition of individual slabs and can be used in existing slab reheat furnaces having only minimal instrumentation. More accurate zone temperature calculations are possible because a non-linear zone temperature distribution approximating actual conditions in the furnace has been employed. While the invention has been described with a certain degree of particularity, it will be understood that the present disclosure of the preferred embodiment has been made only by way of example and that various changes and modifications may be made by those skilled in the art without departing from the true spirit and scope of the invention. Accordingly, it is intended that the patent shall cover, by suitable expression in the appended claims, whatever features of patentable novelty exist in the invention disclosed.

What is claimed is:

1. In a slab reheat furnace having at least one zone with a controllable heating means through which metal slabs are moved, a method of controlling the heating means, comprising the steps of:

(a) predicting the average temperature of each slab in the zone;

(b) establishing a deviation between the predicted average temperature of each slab and a desired average temperature of each slab for the particular location of each slab in the zone;

(c) identifying the slab whose temperature deviation is such that the slab will require the greatest amount of time to be heated to the desired average temperature; and, (d) adjusting the output of the heating means to such an extent that the identified slab will be heated to the desired average temperature.

2. The method of claim 1, wherein the steps of the method are repeated following each change in the number or location of slabs in the zone or after an interval of predetermined length of time if no change in number or locations has occurred during the interval.

3. The method of claim 1, wherein the step of predicting the average temperature of each slab includes the steps of:

(a) predicting the surface temperature of the slab as a function of the thermal properties, dimensions, location, velocity, and past thermal history of the slab;

(b) predicting the radiation heat source temperature at each location in the zone; and, (c) employing the predicted radiation heat source temperature in combination with the surface temperature to calculate the average temperature.

4. The method of claim 3, wherein the average temperature of a slab at a given zone location i is predicted by solving the following simultaneous, nonlinear differential equations:

$$T_{si} = T_{ai} + K_1 H_i^2 \cdot \frac{dT_{ai}}{dt}$$

$$\frac{dT_{ai}}{dt} = \frac{K_2 e_i}{H_i} [(T_{gi} + 460)^4 - (T_{si} + 460)^4]$$

where $T_{si}$ is the predicted surface temperature of the slab, $T_{ai}$ is the predicted average temperature of the slab, $T_{gi}$ is the gas temperature in the zone at the slab location, $e_i$ is the emissivity of the slab, $H_i$ is the thickness of the slab, and $K_1$ and $K_2$ are constants dependent upon the properties of the slab.

5. The method of claim 1, wherein the adjustment of the output of the heating means is limited to a predetermined maximum to avoid melting of slab surfaces.

6. The method of claim 1, wherein the temperatures in the zone are established by:

(a) measuring the apparent radiation heat source temperature in the zone at only one location;

(b) establishing a series of predicted temperature deviations from the measured temperature at all locations in the zone;

(c) subtracting the predicted temperature deviation values from the measured gas temperature to establish a predicted radiation heat source temperature at any location in the zone.

7. The method of claim 6, wherein the predicted temperature deviations are calculated as a function of the distance from the heating means, as well as slab thickness and velocity, and type of fuel.

8. The method of claim 6 wherein the predicted radiation heat source temperature represents heat flux from all radiation sources in the zone, including the heating means, the walls of the furnace, and the slabs themselves.

9. In a slab reheat furnace having at least one zone with a controllable heating means through which metal slabs are moved, a method of controlling the heating means, comprising the steps of:

(a) predicting the average temperature of each slab in the zone;

(b) establishing a deviation between the predicted average temperature of each slab and a desired average temperature of each slab for the particular location of each slab in the zone;

(c) identifying the slab whose temperature deviation is such that the slab will require the greatest amount of time to be heated to the desired average temperature;

(d) establishing a signal proportional to the magnitude of the temperature deviation of the identified slab; and, (e) adjusting the output of the heating means as a function of the established signal.

10. The method of claim 9, wherein the established signal is compared with other signals representing a nominal temperature of the zone and a measured maximum temperature in the zone.

11. In a slab reheat furnace having at least one zone with a conrollable heating means through which metal slabs are moved, a method of controlling the heating means, comprising the steps of:

(a) predicting the average temperature of each slab in the zone;

(b) establishing a deviation between the predicted average temperature of each slab and a desired average temperature of each slab for the particular location of each slab in the zone;

(c) identifying the slab having the greatest temperature deviation below desired average temperature; and, (d) adjusting the output of the heating means to such an extent that the identified slab will be heated to the desired average temperature.

12. The method of claim 11, wherein the adjustment of the output of the heating means is limited to a predetermined maximum to avoid melting of slab surfaces.

13. The method of claim 11, wherein the step of predicting the average temperature of each slab includes the steps of:

(a) predicting the surface temperature of the slab as a function cf the thermal properties, dimensions, location, velocity, and past thermal history of the slab;

(b) predicting the radiation heat source temperature at each location in the zone; and, (c) employing the predicted radiation heat source temperature in combination with the surface temperature to calculate the average temperature.

14. The method of claim 13, wherein the average temperature of a slab at a given zone location i is predicted by solving the following simultaneous, nonlinear differential equations:

$$T_{si} = T_{ai} + K_1 H_i^2 \cdot \frac{dT_{ai}}{dt}$$

$$\frac{dT_{ai}}{dt} = \frac{K_2 e_i}{H_i} [(T_{gi} + 460)^4 - (T_{si} + 460)^4]$$

where $T_{si}$ is the predicted surface temperature of the slab, $T_{ai}$ is the predicted average temperature of the slab, $T_{gi}$ is the gas temperature in the zone at the slab location, $e_i$ is the emissivity of the slab, $H_i$ is the thickness of the slab, and $K_1$ and $K_2$ are constants dependent upon the properties of the slab.

15. In a slab reheat furnace having at least one zone with a controllable heating means through which metal slabs are moved, a method of controlling the heating means, comprising the steps of:

(a) predicting the average temperature of each slab in the zone;

(b) establishing an average temperature deviation between the predicted average temperature of each slab and a desired average temperature of each slab for the particular location of each slab in the zone.

(c) predicting the surface temperature of each slab in the zone;

(d) establishing a surface temperature deviation between the predicted surface temperature of each slab and a predetermined maximum surface temperature of each slab for the particular location of each slab in the zone;

(e) identifying the slab whose average temperature deviation below the desired average temperature is such that the slab will require the greatest period of time to be heated to the desired average temperature;

(f) establishing a first signal proportional to the magnitude of the average temperature deviation of the identified slab;

(g) establishing a second signal if the predicted surface temperature of any slab in the zone is within a predetermined proximity of its predetermined maximum allowable surface temperature;

(h) preventing the establishment of a first signal if a second signal is established; and (i) increasing, in the absence of a second signal, the output of the heating means as a function of the magnitude of the first signal.

16. The method of claim 15, wherein the predicted average and surface temperatures of each slab are based on a calculated radiation heat source temperature at each location in the zone, the radiation heat source temperature at each location being determined by:

(a) measuring the temperature in the zone at only one location;

(b) calculating the temperature offset between the measured temperature and a temperature at any location in the zone representative of a model taking into account slab thickness, slab velocity, and type of fuel; and, (c) subtracting the calculated temperature offset values from the measured temperature in the zone.

* * * * *